US005590238A

United States Patent [19]

Ericson

[11] Patent Number: 5,590,238

[45] Date of Patent: Dec. 31, 1996

[54] HORIZONTALLY AND VERTICALLY MOVABLE RADIANT HEATER FOR REMOVING PAINT FROM A SURFACE

[75] Inventor: Birger Ericson, Alingsas, Sweden

[73] Assignee: Birger Ericson Fasad AB, Sweden

[21] Appl. No.: 526,544

[22] Filed: Sep. 12, 1995

Related U.S. Application Data

[63] Continuation of Ser. No. 923,940, filed as PCT/SE91/00166, Mar. 4, 1991, abandoned.

[30] Foreign Application Priority Data

Mar. 5, 1990 [SE] Sweden ..... 9000763

[51] Int. Cl.[6] ..... B44D 3/16; E04G 23/00

[52] U.S. Cl. ..... 392/412; 392/413; 392/415; 392/432; 134/38; 432/225; 432/229

[58] Field of Search ..... 392/412, 413, 392/415, 432–435, 436; 134/38, 105, 165; 15/354, 102, 250.05, 256.5; 34/270, 107, 144; 432/229, 225; 219/403, 404; 156/380.9

[56] References Cited

U.S. PATENT DOCUMENTS

| | | | |
|---|---|---|---|
| 1,376,593 | 5/1921 | Tuttle | 392/413 |
| 2,613,307 | 11/1952 | Mirand | 392/435 |
| 2,761,948 | 9/1956 | Todd | 34/270 |
| 2,798,930 | 7/1957 | Frost | 219/403 |
| 2,841,684 | 7/1958 | Miskella | 392/415 |
| 2,848,592 | 8/1958 | Mergen | 219/404 |
| 3,071,871 | 1/1963 | Ramseur, Jr. | 34/150 |
| 3,223,826 | 12/1965 | Macaluso, Jr. | 392/413 |
| 3,292,418 | 12/1966 | Oehme et al. | 219/405 |
| 3,656,493 | 4/1972 | Black et al. | 134/165 |
| 3,683,154 | 8/1972 | Kipple et al. | 219/412 |
| 4,025,984 | 5/1977 | Hoener, Jr. | 15/302 |
| 4,314,141 | 2/1982 | Vangsted et al. | 392/415 |
| 4,444,146 | 4/1984 | De Witz et al. | 134/184 |
| 4,445,850 | 5/1984 | Hausen, Jr. et al. | 432/229 |
| 4,629,850 | 12/1986 | Tanabe | 219/404 |
| 4,806,194 | 2/1989 | Wald | 156/380.9 |
| 4,809,677 | 3/1989 | Mackin et al. | 600/22 |
| 4,856,700 | 8/1989 | Sakaguchi et al. | 392/415 |
| 5,167,003 | 11/1992 | Montanari et al. | 219/405 |

FOREIGN PATENT DOCUMENTS

| | | | |
|---|---|---|---|
| 545548 | 11/1980 | Australia . | |
| 562042 | 11/1923 | France | 392/415 |
| 2106710 | 9/1972 | Germany | 392/436 |
| 490974 | 5/1968 | Switzerland . | |
| 419618 | 11/1934 | United Kingdom | 392/415 |
| 667178 | 2/1952 | United Kingdom | 392/411 |

OTHER PUBLICATIONS

Excerpt from *Industrial Applications of Infra–Red*, by J. D. Hall, McGraw–Hill Book Co., 1947, p. 159.

*Primary Examiner*—John A. Jeffery

*Attorney, Agent, or Firm*—Lerner, David, Littenberg, Krumholz & Mentlik

[57] ABSTRACT

A device for removing layers of paint from a surface including layers of paint which may comprise a base layer of oil paint. The paint is softened by radiation by means of at least one heating source. Immediately thereafter, the paint is removed mechanically from the surface. The apparatus comprises a carrier which may retain one or more sources of infrared radiation, a device for guided travel of the carrier in the horizontal plane along the painted surface and a device for guided travel of the carrier in the vertical plane along the painted surface.

33 Claims, 2 Drawing Sheets

HORIZONTALLY AND VERTICALLY MOVABLE RADIANT HEATER FOR REMOVING PAINT FROM A SURFACE

This is a continuation of application Ser. No. 07/923,940, filed as PCT/SE91/00166, Mar. 4, 1991, now abandoned.

TECHNICAL FIELD

The present invention relates to means for removing one or more layers of paint from a wooden facade, said layers of paint comprising a base layer of oil paint, and comprising a carrier for one or more sources of infrared radiation, means for guided travel of the carrier in the horizontal plane along the facade, and means for guided travel of the carrier in the vertical plane along the facade.

STATE OF THE ART

When restoring wood surfaces on old houses, it is normally obligatory to strip off a number of layers of ugly, cracked and flaking oil- and/or plastic-based paint. Normally all layers of paint have to be completely stripped from the face of the wood, so that existing rot damages can be discovered. There are several methods to remove old paint, but no existing method is free from problems. For example, paint can be stripped by scraping or sanding, either involving a large use of expensive labor or spreading of environmentally hazardous dust and disturbing noise. Previously, a blow torch was used to burn away paint, or rather to soften it by heating, so that it would be easier to scrape it away from the wood. This method has now been terminated because of the fire hazard from the open flame. Nowadays, a hot air gun is used as a substitute for the blow torch. However, it is very difficult to gain real efficiency with this tool, because transmittal of heat from the tool to the surface very much depends upon the outdoor climate with winds and air temperature. Thus, it is difficult to accomplish an equally distributed heating to the right temperature. If the surface is heated too much, the wood surface is unwontedly dried. If the surface is heated too little, the paint will be hard to remove and requires more work with the paint scraper. The work is demanding for arms and shoulders, because the hot air gun must be held continuously in one hand and the paint scraper in the other hand.

AU-A-545 548 describes a hand held device for removing paint with which the user may direct a beam of infra-red radiation to the surface. This known device is equally demanding for arms and shoulders as the hot air gun.

The presently most preferred professional methods for removing paint from wood facades use either caustic solution or strong hydrocarbon based solutions. Washing with caustic solution causes many problems because caustic solution is strongly aggressive to the skin. Normally, a high pressure water spray is used for application of the caustic solution, for washing in several steps and for application of neutralizing agents. This method requires the spreading of several liters of liquid per square meter treated surface and affects the environment, for example plants surrounding the building. The neutralizing of the cleaned wood surface requires the use of acetic acid which, for example, attacks nails in a facade. Another significant drawback with this method is that the wood surface is dried out, i.e. the natural protective substances in the wood, e.g. resin, is removed and cracks appear in the wood, which in the long run can have very negative effects when restoring old historical buildings.

The use of hydrocarbon based solutions is associated with risks for occupational diseases because these substances are usually very toxic. These substances are also very expensive to buy, making this method expensive in comparison with washing with caustic solution.

TECHNICAL PROBLEM

One aim of the present invention is therefore to solve the problem of removing paint from wood surfaces in an efficient, environmentally acceptable and economical way.

SOLUTION

This aim is achieved according to the invention in that the means for vertical movement comprises at least one vertical guide rod, running through lock means at the carrier, enabling movement of the carrier along the rod and locking at optional height, that the length of the guide rod is adjustable by screwing on or off rod segments, that the radiation source comprises one or more infrared heating tubes, which are longitudinally oriented in parallel with the grain of the wood surface, that the carrier is rotatable at least about 90° in relation to the guide rod, and that the infra-red heating tubes are movably mounted in the carrier, so that their relative distance is adjustable.

In one preferred embodiment of the present invention, the apparatus for facilitating the removal of paint from a surface comprises heating means which may comprise at least one heat source for heating a painted surface. The apparatus also comprises carrier means for retaining the heating means therein. The carrier means is preferably selectively movable with respect to the painted surface and the at least one heat source may be adjustably mounted on the carrier means so that the intensity of the heat applied to a given location on the painted surface can be selectively increased or decreased. Guide means are provided for guiding the selective movement of the carrier means with respect to the painted surface and for retaining the carrier means in the vicinity of the painted surface so that the carrier means and the heating means thereon can be selectively exposed to various areas on the painted surface.

In another preferred embodiment, the guide means may comprise a vertically arranged guide rod and the carrier means may be mounted on the guide rod for selective slidable movement therealong.

In another preferred embodiment, the guide rod may comprise a plurality of rod segments connectable in an end-to-end arrangement to obtain the overall length of the guide rod. Preferably the guide rod is adjustable so that the length thereof may be increased upon connection of one or more of the plurality of rod segments thereto. Similarly, the length may be decreased upon removal of one or more the rod segments therefrom.

In another preferred embodiment, the first and second ends of each of the rod segments are threaded whereby the length of the guide rod may be adjusted upon threadably connecting or disconnecting adjacent ones of the plurality of rod segments to each other.

Preferably, the guide means of the present invention comprises locking means for selectively locking the carrier means at a predetermined location on the guide rod.

In another preferred embodiment, the guide means further comprises means for obtaining selective horizontal movement of the carrier means with respect to the painted surface. The means for obtaining selective horizontal movement may comprise at least one trolley and a rail in which the at least one trolley is mounted. The rail may include a horizontal guide slot therein defining a horizontal plane along which the at least one trolley is permitted to slide. In this preferred embodiment, the vertically arranged guide rod is preferably connected to the at least one trolley and extends generally perpendicular to the horizontal guide path so that the carrier means, and thus, the heating means, may obtain both vertical and horizontal movements along the painted surface.

In another preferred embodiment, the at least one heat source comprises a plurality of heat sources arranged at adjustable spaced distances from each other within the carrier means. In this embodiment, the carrier means may comprise heat source adjustment means for permitting selective adjustment of the spaced distances between adjacent ones of the plurality of heat sources. The plurality of heat sources may comprise infrared heating tubes.

The present invention is particularly useful for removing paint from a wooded facade which has at least one layer of an oil based paint thereon. In the present invention, which is used to remove such oil based paint from a wooden facade, the plurality of heating tubes are preferably arranged within the carrier means in a manner so that the predetermined length thereof extends along a direction which is generally parallel to the direction of the wood grains of the wooden facade.

In another preferred embodiment, the heat source adjustment means arranged within the carrier means may comprise a first guide slot and a second guide slot spaced from the first guide slot and arranged generally parallel thereto. In this embodiment, the plurality of heat sources may be connected to first and second guide slots for selective slideable movement therealong.

Preferably, the present invention also comprises adjustable distance means connected to the carrier means for adjusting the distance which may exist between the carrier means and the painted surface. Preferably, the adjustable distance means comprises anchoring means for securing the carrier means to the painted surface while the heating means applies heat thereto.

In a further preferred embodiment of the present invention, the carrier means may comprise rotation means for rotating the carrier means a predetermined degree with respect to the vertically arranged guide rod on which the carrier means is slideably mounted. In a preferred embodiment, the predetermined degree of rotation is at least 90°

The mechanical work upon the surface can be done by scraping. It has been found to be surprisingly simple to remove the paint from the wood surface in this way, as soon as it has been softened.

According to a preferable embodiment of the invention, the means for horizontal travel comprises a tubular pro-file rail which has a slit in the bottom and at least one trolley which can move within the tubular profile rail and is vertically connected to the carrier. This rail can easily be attached to the bottom of the eave board. If the carrier also is provided with adjustable distance means, the distance between the carrier and the facade can be adjusted for control of radiation intensity.

DESCRIPTION OF THE FIGURES

An exemplary embodiment of the invention will now be described in greater detail with reference to the attached drawings, in which.

PREFERRED EMBODIMENTS

Figure 1:
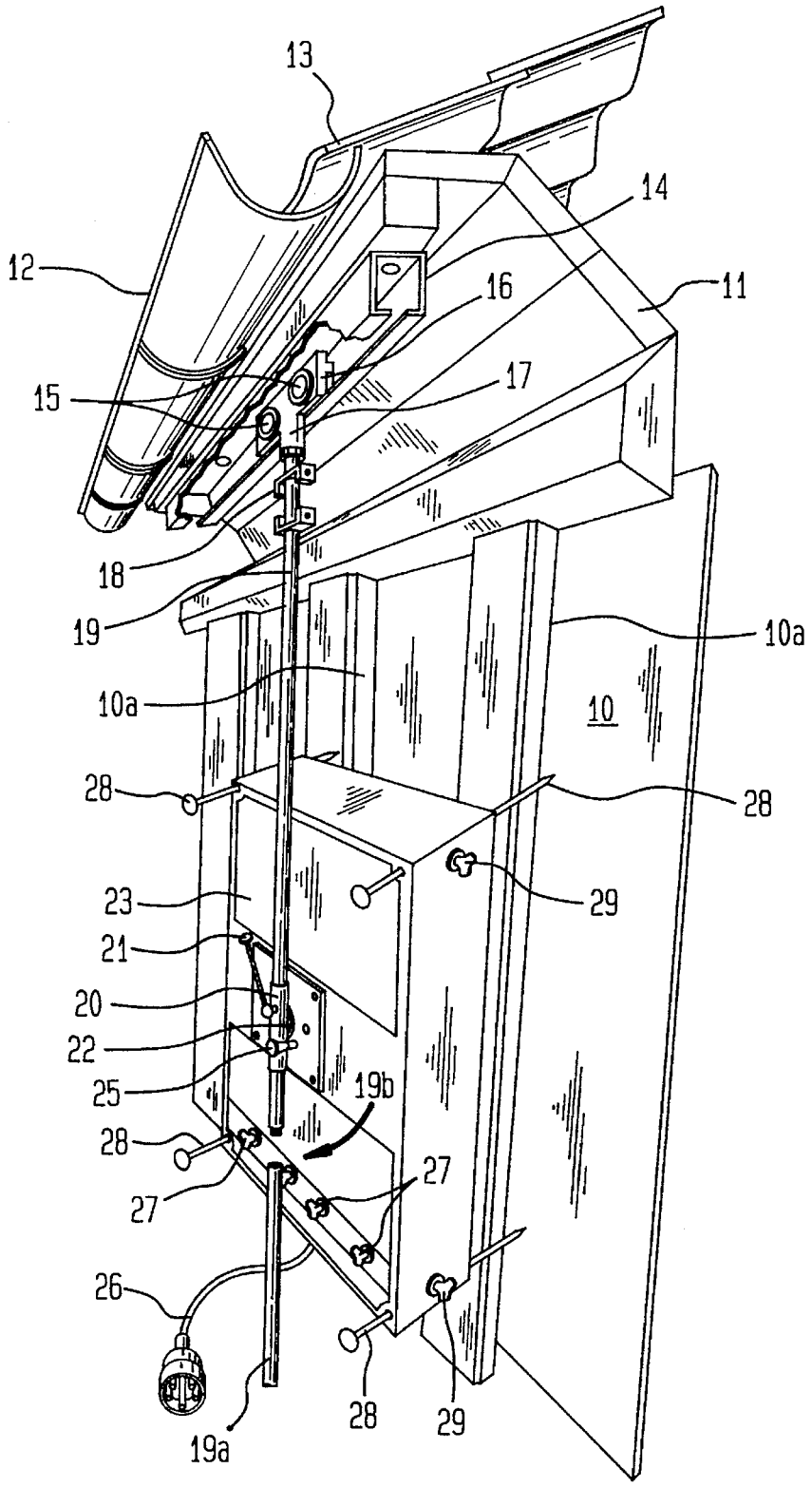
FIG. 1 is a perspective view of a facade with the means according to the invention set up for use.

FIG. 1 shows a wood facade 10 which is made as a cover boarding, and ending at the top with a angled eave board 11 with a roof gutter 12 and roofing tiles 13.

A tubular profile rail 14 which is slit at the bottom is attached to the bottom of the eave, at a suitable distance from the facade 10. A trolley 16 with wheels 15 runs inside the tubular rail. The trolley is provided with an attachment ear 17 protruding downwards through the slit and to which is mounted a vertical toggle link 18, which in its turn forms an attachment for a vertical rod 19.

The length of the rod 19 is adjustable because it is formed by a number of segments 19*a*, which can be screwed on to or off from the end, which is hinted at 19*b*. The rod 19 runs through a tubular holder 20, which can be locked relative the rod by means of a handle 21. The holder 20 is rotatable connected via a bearing 22 to the middle of a rectangular box shaped carrier 23 with four internally mounted infrared heating tubes 24 (see FIG. 2). The holder 20 can be arrested relative the carrier 23 by means of a spring loaded pin 25 in one of two with an angle of about 90° from each other distanced angle positions. This makes it possible to rotate the carrier from a position where the infra-red heating tubes are vertically oriented, to a position where they are horizontally oriented.

The infrared heating tubes are connected via a mutual cable 26 and a jack plug to a plug socket for two- or three phase current. The carrier is provided with a contact breaker 27 for each tube, so that the tubes can be switched on and off individually for adjustment of the radiation intensity.

Figure 2:
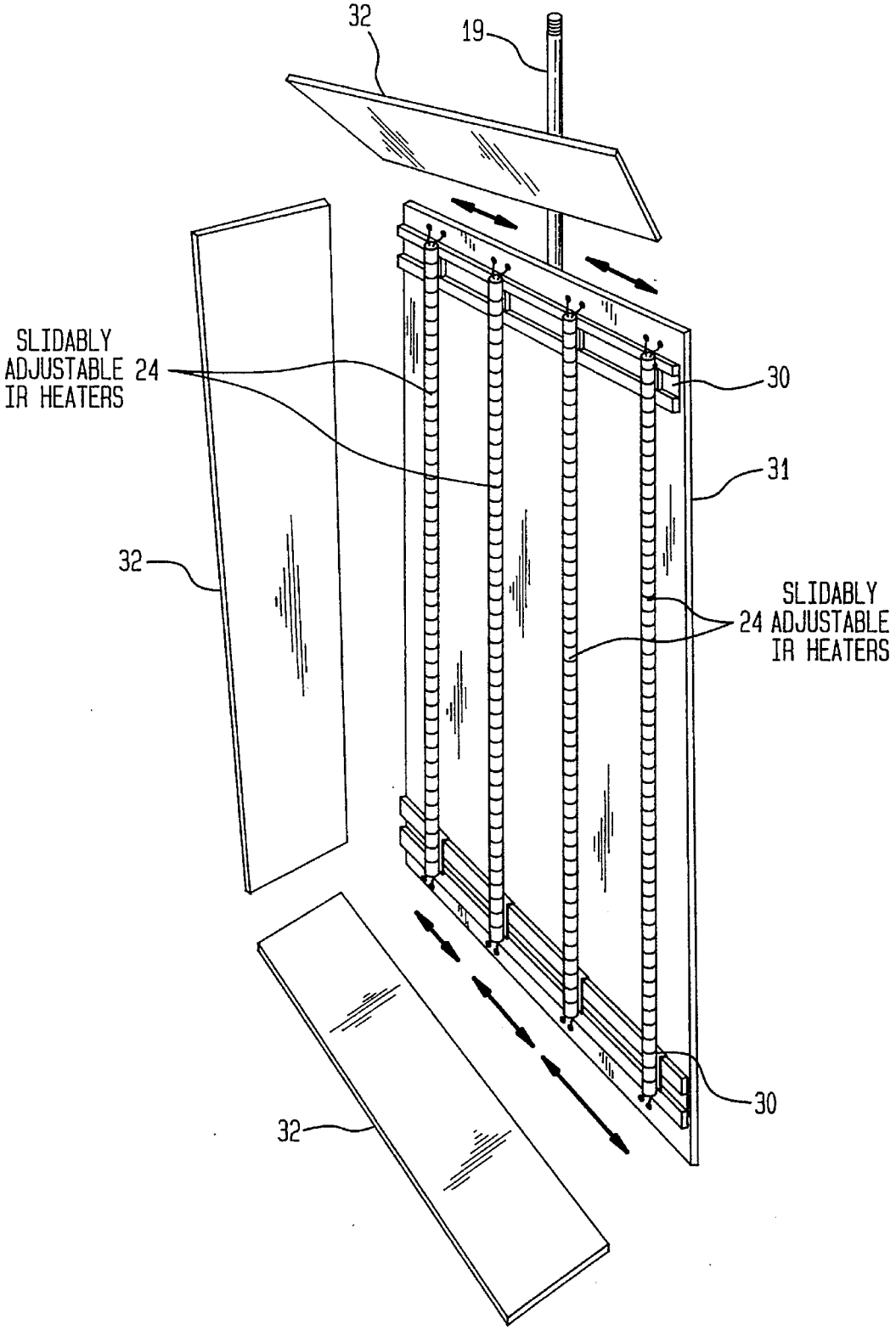
FIG. 2 is an explosion view in perspective showing the arrangement of the infra-red heating tubes in the carrier.

Each of the four corners of the carrier 23 is provided with a distance means 28, in the form of a pointed stick with its point towards the facade and a ball shaped handle at the opposite end. Each stick can be moved axially through the carrier 23 and locked relative to it by means of a screw 29. FIG. 2 shows that the tubes 24 are mounted between two rails 30 at the inside of the rear wall of the carrier 31. This makes it possible to move the tubes 24 sideways, so that their respective interval is altered. This arrangement makes it possible to vary the radiation intensity over the surface which is delimited by the side walls 32 of the carrier, for example, so that a main proportion of the radiation can be concentrated to the space between two cover boards 10*a*.

It is possible to move the carrier 23 with the infrared heating tubes 24 advantageously both horizontally and vertically along the entire facade 10, for systematic treatment of one part of the facade at time which is delimited by the side walls of the carrier, until the entire facade surface has been stripped from paint.

The carrier 23, which is open towards the wall, is anchored in the correct position on the wall by means of the points of the sticks 28. To this end, the toggle link 18 provides for a certain room for sideways adjustment of the carrier 23. Then the radiation from the infra-red heating tubes 24 are put to work until the paint warmed through and made soft. The radiation heat results in that certain elements of the oil paint are transformed to the liquid state, while other parts of the paint is gasified and causes the paint to blister. Now it is very easy to remove the paint with a scraper. Most old wood buildings are painted in a large number of layers with oil based paint, and even if these layers have been painted over with plastic based paint, it will be just as easy to remove said paint, because the bottom layers on the wood are loosened up in the manner described above.

The above described heating of a section of the facade takes between a half minute and one minute. Then the carrier 23 is moved for heat treatment of the next untreated section. During heating of the next following facade section, the soft paint is removed from the already heated section. In this way the paint is removed rapidly and efficiently. It has been showed that radiation treatment of a wood facade has a deep effect in the wood, which is advantageous because there will be plenty of time for removing paint before it again gets hard by cooling. At the same time, moisture in the facade is removed.

A surprising technical effect from this treatment is also provided because resin gum in the wood board which has been leaching from outer wood facade during all the years, and therefore is more current at the inside of the board, tend to be evenly distributed in the board by the heating, i.e. will be drawn to the outside. This partly rejuvenates the natural defence of the outer wood surface against attacks form moisture and mold. It has also been shown that the facade only needs a very short period of drying before it can be coated with new paint, if it has been wet by rain in the interval.

The invention is not limited to the exemplary embodiment described above, but various alternatives are conceivable within the scope of the subsequent claims. For example, the carrier can have a different design, as well as different means for travelling along a facade.

I claim:

1. An apparatus for facilitating the removal of paint from a vertical wall surface, comprising:

heating means including at least one heat source for heating a painted vertical wall surface;

carrier means for retaining said heating means in operative position with respect to a painted vertical wall surface, said carrier means being selectively movable with respect to a painted vertical wall surface;

guide means for obtaining horizontal and vertical guided travel along distinct horizontal and vertical paths of said carrier means with respect to the painted vertical wall surface and for retaining said carrier means in the vicinity of a painted vertical wall surface so that said heating means can be selectively moved and exposed to various areas on a painted vertical wall surface; and fastening means for securing a portion of said guide means to a surface sufficient to permit secured placement of said heating means in an operative position with respect to a painted vertical wall surface.

2. The apparatus of claim 1 wherein said guide means comprises a vertically arranged guide rod, said carrier means being mounted on said guide rod for selective slidable movement therealong.

3. The apparatus of claim 2 wherein said guide rod has an overall length and comprises a plurality of rod segments, each of said plurality of rod segments having first and second ends and being arranged in assembled position with at least one of said first and second ends connected to a corresponding one of said first and second ends of an adjacent one of said plurality of rod segments to obtain said overall length of guide rod.

4. The apparatus of claim 3 wherein said overall length of said guide rod may be adjusted upon connection or disconnection of one or more of said plurality of rod segments thereto.

5. The apparatus of claim 4 wherein said first and second ends of said plurality of rod segments are threaded whereby said overall length of said guide rod may be adjusted upon threadably connecting or disconnecting adjacent ones of said plurality of rod segments to or from each other.

6. The apparatus of claim 2 wherein said guide means further comprises locking means for selectively locking said carrier means at a predetermined location on said guide rod.

7. The apparatus of claim 2 wherein said guide means further comprises means for obtaining selective horizontal movement of said carrier means with respect to a painted surface.

8. The apparatus of claim 7 wherein said means for obtaining selective horizontal movement comprises at least one trolley and rail means including a horizontal guide slot therein for permitting said at least one trolley to slide along a horizontal plane defined by said horizontal guide means, said vertically arranged guide rod being connected to said at least one trolley and extending generally perpendicular to said horizontal guide slot.

9. The apparatus of claim 7 wherein said carrier means comprises rotation means for rotating said carrier means a predetermined degree with respect to said vertically arranged guide rod.

10. The apparatus of claim 9 wherein said predetermined degree of rotation is at least 90°.

11. The apparatus of claim 1 wherein said guide means comprises means for obtaining selective horizontal movement of said carrier means with respect to a painted surface.

12. The apparatus of claim 11 wherein said means for obtaining selective horizontal movement comprises at least one trolley and rail means including a horizontal guide slot therein for permitting said at least one trolley to slide along a horizontal plane defined by said horizontal guide slot.

13. The apparatus of claim 1 wherein said at least one heat source comprises a plurality of heat sources arranged at adjustable spaced distances from each other on said carrier means.

14. The apparatus of claim 13 wherein said carrier means further comprises heat source adjustment means for permitting selective adjustment of the spaced distances between adjacent ones of said plurality of heat sources.

15. The apparatus of claim 14 wherein said heat source adjustment means comprises a first guide slot and a second guide slot arranged substantially parallel to said first guide slot and being spaced therefrom, said at least one infrared heating tube being connected to said first and second guide slots for selective slidable movement therealong.

16. The apparatus of claim 1 wherein said at least one heat source comprises at least one infrared heat source.

17. The apparatus of claim 16 wherein a painted surface comprises a wooden facade having wood grains extending along a certain direction thereof, said at least one infrared heat source comprising at least one infrared heating tube having a predetermined length, said at least one infrared heating tube being arranged within said carrier means so that the predetermined length thereof extends along a direction generally parallel to the direction of a wood grains of a wooden facade.

18. The apparatus of claim 1 wherein said carrier means is initially retained at a predetermined spaced distance from a painted surface, said apparatus further comprising adjustable distance means connected to said carrier means for adjusting the predetermined spaced distance between said carrier means and a painted surface.

19. The apparatus of claim 1 wherein said adjustable distance means comprises anchoring means for securing the carrier means to a painted surface while said heating means applies heat thereto.

20. An apparatus for facilitating the removal of paint from a painted vertical wall surface, comprising:

heating means comprising a plurality of heat sources arranged at adjustable spaced distances from each other for heating a painted vertical wall surface;

carrier means for retaining said heating means in operative position with respect to a painted vertical wall surface, said carrier means being selectively movable with respect to a painted vertical wall surface;

guide means for obtaining horizontal and vertical guided travel along distinct horizontal and vertical paths of said carrier means with respect to a painted vertical wall surface and for retaining said carrier means in the vicinity of the painted vertical wall surface, said guide means comprising a vertically arranged guide rod, said carrier means being mounted on said guide rod for selective slidable movement therealong so that said heating means can be selectively moved and exposed to various areas on a painted vertical wall surface; and fastening means for securing a portion of said guide means to a surface sufficient to permit secured placement of said heating means in an operative position with respect to a painted vertical wall surface.

21. The apparatus of claim 20 wherein said plurality of heat sources comprise a plurality of infrared heat sources.

22. The apparatus of claim 25 wherein said plurality of infrared heat sources comprise a plurality of infrared heating tubes.

23. The apparatus of claim 20 wherein said guide rod has an overall length and comprises a plurality of rod segments, each of said plurality of rod segments having first and second ends and being arranged in assembled position with at least one of said first and second ends connected to a corresponding one of said first and second ends of an adjacent one of said plurality of rod segments to obtain said overall length of guide rod.

24. The apparatus of claim 23 wherein said overall length of said guide rod may be adjusted upon connection or disconnection of one or more of said plurality of rod segments thereto.

25. The apparatus of claim 24 wherein said first and second ends of said plurality of rod segments are threaded whereby said overall length of said guide rod may be adjusted upon threadably connecting or disconnecting adjacent ones of said plurality of rod segments to or from each other.

26. The apparatus of claim 25 wherein said guide means further comprises locking means for selectively locking said carrier means at a predetermined location on said guide rod.

27. The apparatus of claim 26 wherein said guide means further comprises means for obtaining selective horizontal movement of said carrier means with respect to a painted surface.

28. The apparatus of claim 27 wherein said means for obtaining selective horizontal movement comprises at least one trolley and rail means including a horizontal guide slot therein for permitting said at least one trolley to slide along a horizontal plane defined by said horizontal guide means, said vertically arranged guide rod being connected to said at least one trolley and extending generally perpendicular to said horizontal guide slot.

29. The apparatus of claim 20 wherein said carrier means further comprises heat source adjustment means for permitting selective slidable adjustment of the spaced distances between adjacent ones of said plurality of heat sources so that the intensity of the heat applied to a painted vertical wall surface can be selectively concentrated on a preselected area.

30. The apparatus of claim 29 wherein said heat source adjustment means comprises a first guide slot and a second guide slot arranged substantially parallel to said first guide slot and being spaced therefrom, said plurality of heat sources being connected to said first and second guide slots for selective slidable movement therealong.

31. The apparatus of claim 29 wherein said heat source adjustment means comprises a first guide slot and a second guide slot arranged substantially parallel to said first guide slot and being spaced therefrom, said at least one infrared heating tube being connected to said first and second guide slots for selective slidable movement therealong.

32. An apparatus for facilitating the removal of paint from a surface, comprising:

heating means comprising a plurality of heat sources arranged at adjustable spaced distances from each other for heating a painted surface;

carrier means for retaining said heating means thereon, said carrier means being selectively movable in the vertical and horizontal directions with respect to a painted surface; and guide means for obtaining horizontal and vertical guided travel along distinct horizontal and vertical paths of said carrier means with respect to a painted surface and for retaining said carrier means in the vicinity of a painted surface, said guide means comprising a horizontally arranged track and a vertically arranged guide rod mounted for selective unimpeded horizontal movement along said track, said carrier means being mounted on said guide for selective vertical slidable movement therealong so that said heating means can be selectively moved and exposed to various areas on a painted surface.

33. The apparatus of claim 32 wherein said carrier means further comprises heat source adjustment means for permitting selective slidable adjustment of the spaced distances between adjacent ones of said plurality of heat sources so that the intensity of the heat applied to a painted vertical wall surface can be selectively concentrated on a preselected area.

* * * * *

UNITED STATES PATENT AND TRADEMARK OFFICE

CERTIFICATE OF CORRECTION

PATENT NO. : 5,590,238

DATED : December 31, 1996

INVENTOR(S) : Ericson

It is certified that error appears in the above-identified patent and that said Letters Patent is hereby corrected as shown below:

Column 3, line 56, delete "pro-file" and insert --profile-- therefor.

Column 5, line 23, delete "form" and insert --from-- therefor.

Column 6, line 23, delete "7" and insert --2-- therefor.

Column 6, line 60, "direction of a wood" should read --direction of wood--.

Column 7, line 31, delete "25" and insert --21-- therefor.

Signed and Sealed this

Thirteenth Day of May, 1997

Bruce Lehman

*Attest:*

BRUCE LEHMAN

*Attesting Officer*

*Commissioner of Patents and Trademarks*